US006108848A

United States Patent [19]

Monahan

[11] Patent Number: 6,108,848

[45] Date of Patent: Aug. 29, 2000

[54] MOP WITH SELF-CONTAINED WRINGER

[76] Inventor: Pat Monahan, 202 N. Oak, Arcola, Ill. 61910

[21] Appl. No.: 09/204,933

[22] Filed: Dec. 3, 1998

[51] Int. Cl.[7] ..... A47L 13/14

[52] U.S. Cl. ..... 15/119.1

[58] Field of Search ..... 15/116.1, 119.1, 15/120.1, 120.2, 228, 229.1, 118

[56] References Cited

U.S. PATENT DOCUMENTS

| | | | |
|---|---|---|---|
| 135,400 | 2/1873 | Boyden | 15/119.1 |
| 1,709,622 | 4/1929 | Justis | 15/120.2 |
| 3,364,512 | 1/1968 | Yamashita et al. | 15/119.1 |
| 3,462,788 | 8/1969 | Abbott | 15/119.1 |
| 3,501,796 | 3/1970 | Moss | 15/118 |
| 3,946,457 | 3/1976 | Robinson | 15/119.1 |
| 4,809,387 | 3/1989 | Nakamura et al. | 15/119.1 |
| 5,577,290 | 11/1996 | Monahan | 15/118 |
| 5,675,858 | 10/1997 | von Meyer | 15/119.1 |

FOREIGN PATENT DOCUMENTS

| | | | |
|---|---|---|---|
| 2622785 | 5/1989 | France | 15/120.1 |
| 1300709 | 12/1972 | United Kingdom | 15/120.2 |

*Primary Examiner*—Gary K. Graham
*Attorney, Agent, or Firm*—R. William Graham

[57] ABSTRACT

A mop having a self-contained wringer includes a handle, a sleeve frictionally movably disposed on the handle such that the sleeve is self supporting along a number of positions of the mop handle, a retainer member connected to an end of the handle and having a retaining surface, a mop head material having one end connected to the retaining surface of the retainer member, a relatively flexible housing portion having a first end connected to the sleeve and a second end extending outwardly therefrom creating a mop head receiving surface area between a portion of the handle and an inner surface of the housing. The housing is further characterized to be generally hemibulbous and include a slit extending from the second end toward the first end such that the housing may movably overlap over itself and to change the receiving surface area. Also, provided is a retrofit self-contained mop wringer housing of the type described for connection to a wet mop of the type described.

17 Claims, 3 Drawing Sheets

MOP WITH SELF-CONTAINED WRINGER

BACKGROUND OF THE INVENTION

1. Field of the Invention

The present invention relates to mops. More particularly, the invention relates to a wet mop having a self-contained wringer and unique wringing element which is incorporated on the mop or may be retrofit to a conventional wet mop.

2. Related Art

There exist numerous types of mops in the art, such as twist mops, squeeze mops, wringer mops, etc. Each of these mops will include a handle, mop head material connected to the handle and means for removing water from the mop head material upon demand.

A problem associated with prior mop designs is the way in which to they wring the absorbed liquid from the mop head material connected to the mop handle. Additionally, in the case of self wringing type mops, there is lacking a sufficient means for wringing the mop head material in a manner to permit effective removal of the absorbed liquid with minimal damage to the mop head material.

Another problem with existing mops is that they do not adequately displace the wringer from the mop head to maximize the use of the mop head material. For example, the mop head material of the self wringing mop is connected to a head having a wringer plate hinged thereto. The wringer plate is pivoted in a manner to squeeze the mop head material. This type of wringer is less desirable as it prevents circumferential access to the mop head material.

Other wringing mechanisms, attached and detached from the mop, twist the mop head material in order to remove the liquid therefrom. This is not desirable as it tends to weaken and wear the material.

Other problems associated with conventional mops is that they have a relatively small footprint for mopping, use only a portion of the yarn/mop head material and which is tangled easily. These mops and their current wringing mechanisms are relatively expensive to produce. Also, current self-contained wringers fail to provide mop squeezing power from the top of the mop head through the bottom.

There remains a need therefore to provide an improved mop, particularly, a mop having a self-contained wringer with improved wringability and positionability of the mop head material. There is also a need to provide a self-contained wringer which retrofitable to a conventional wet mop, such as a deck mop.

SUMMARY OF THE INVENTION

It is an object of the present invention to improve mops.

It is another object of the present invention to improve self-contained wringing mops.

It is a further object to improve the wringability of a mop with a self-contained wringer.

Accordingly, the present invention is directed to a mop having a self-contained wringer includes a handle, a first sleeve frictionally movably disposed on the handle such that the sleeve is self supporting along a number of positions of the mop handle, a retainer member connected to an end of the handle and having a retaining surface, a mop head material having one end connected to the retaining surface of the retainer member, a housing portion having a first end connected to the sleeve and a second end extending outwardly therefrom creating a mop head receiving surface area between a portion of the handle and an inner surface of the housing, wherein said housing is movable along said handle via the first sleeve in a manner to removably enclose the mop head material and enable squeezing of the mop head material through application of pressure on the housing.

The housing is further characterized to be generally hemibulbous and includes a slit extending from the second end toward the first end such that the housing may movably overlap over itself and change the receiving surface area. The diameter of the first end is about half that of the second end and the second end is formed with a radially extending lip.

A second sleeve having a diameter greater than the first end and less than the second end and is slidably movable over the housing. The first sleeve is further characterized to have an end connected to the housing and has another end formed with a radially extending collar to prevent the second sleeve from passing thereby. In this configuration, the second sleeve is maintained between the lip of the housing and the collar of the first sleeve. The first sleeve and housing are preferably integrally formed.

Another aspect of the present invention is directed to a retrofit self-contained wringer for connection to a mop having a handle and mop head connected thereto. The retrofit self-contained wringer includes a first sleeve frictionally movably disposed on the handle such that the sleeve is self supporting along a number of positions of the mop handle and a housing portion having a first end connected to the sleeve and a second end extending outwardly therefrom creating a mop head receiving surface area between a portion of the handle and an inner surface of the housing, wherein said housing is movable along said handle via the first sleeve in a manner to removably enclose the mop head material and enable squeezing of the mop head material through application of pressure on the housing. A second sleeve having a diameter greater than the first end and less than the second end and is slidably movable over the housing. The first sleeve is further characterized to have an end connected to the housing and has another end formed with a radially extending collar to prevent the second sleeve from passing thereby. In this configuration, the second sleeve is maintained between the lip of the housing and the collar of the first sleeve. The first sleeve and housing are preferably integrally formed.

Other objects and advantages will be readily apparent to those skilled in the art upon viewing the drawings and reading the detailed description hereafter.

DETAILED DESCRIPTION OF THE PREFERRED EMBODIMENT

Figure 1:
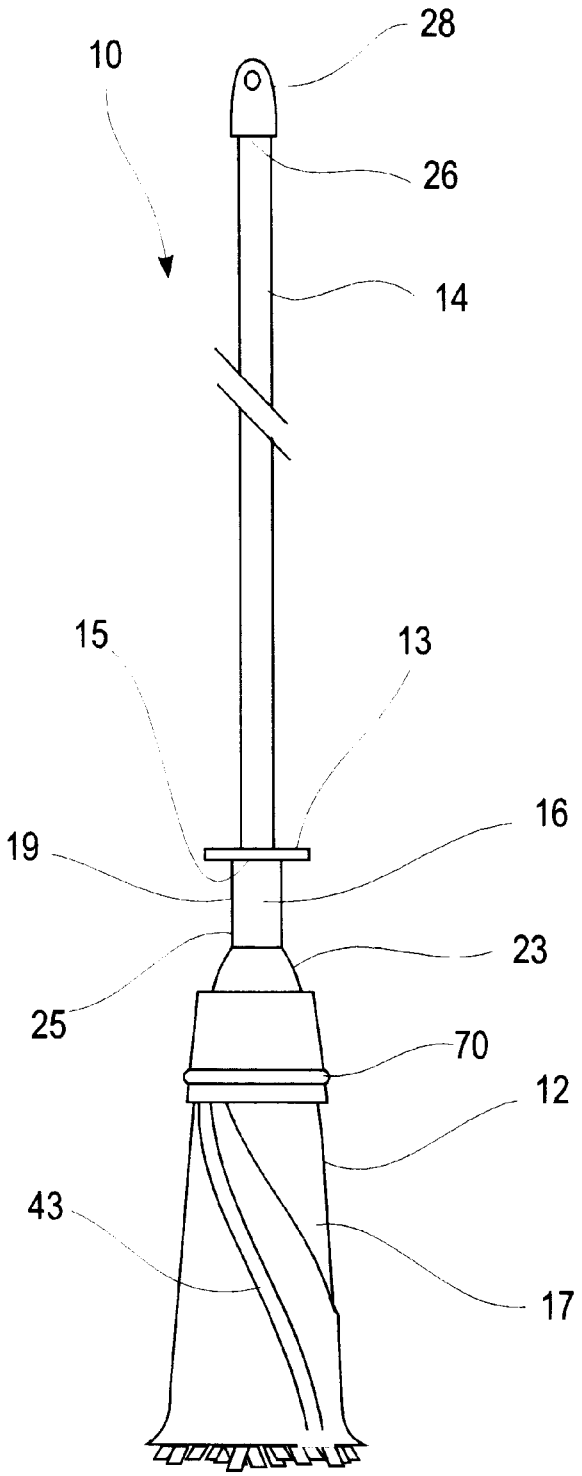
FIG. 1 is an elongated side view of the mop having a self-container wringer of the present invention.

Referring now to the drawings, the present invention relates the mop 10 having a self-contained wringer 12.

While the mop 10 and self-contained wringer 12 are shown together, it is intended as part of the present invention that the self-contained wringer 12 be part of the mop 10 at a point of purchase or as a separate item which may be retrofit to the mop 10. Accordingly, both embodiments are in the subject matter in the claims appended hereto.

The mop 10 includes an elongated handle 14, a sleeve 16, housing 17, retainer member 18, an optional resilient scrub pad material 20, an insert 22 and mop head material 24. The sleeve 16 and housing 17 form the wringer.

The handle 14 includes an end 26 which may also have an eyelet cap 28 connected thereto to permit the mop 10 to be hung when not in use. The handle 14 has another end 30 formed with a threaded surface for a use which will be apparent hereinafter.

Figure 7:
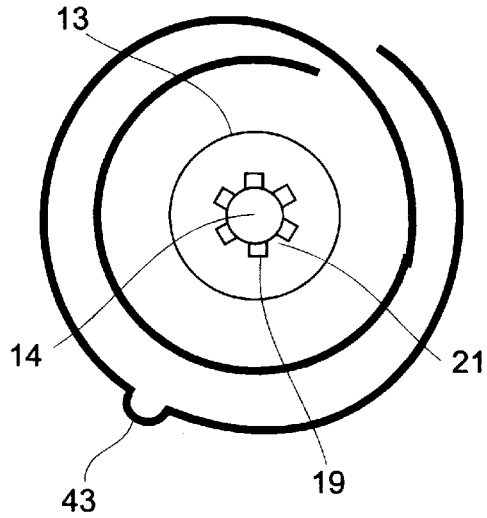
FIG. 7 is top view of the present invention.

The sleeve 16 has an intermediate part 19 which has a plurality of frictionally engaging fingers 21 which bias against the handle 14 as seen in FIG. 7 in a manner which sufficiently hold the sleeve 16 and associated housing 17 in place while permitting the same to be slid to a desired position along the handle 14. Also, the sleeve 16 has an end 15 which is formed with a radially extending collar 13.

The housing 17 is further characterized to be generally hemibulbous and has a first end 23 integrally formed with the end 25 of the sleeve 16. The housing 17 and sleeve 16 are preferably made of relatively flexible material, such as a thermoplastic polymer. The housing 17 includes a slit 27 extending from a second end 29 of the housing 17 toward the first end 23 such that the housing 17 may movably overlap over itself and change a receiving surface area 31 which is formed between the housing 17 and handle 14. The diameter of the first end 23 is about half that of the second end 29 in order to accommodate receiving the mop head material 24. The second end 29 is formed with a radially extending lip 33. The housing 17 has a ridge 43 diagonally extending along the exterior of the housing 17. The thickness of the housing is approximately ⅛ inch. Since the second 29 overlaps itself, the thickness at such end is about ¼ inch.

Figure 2:
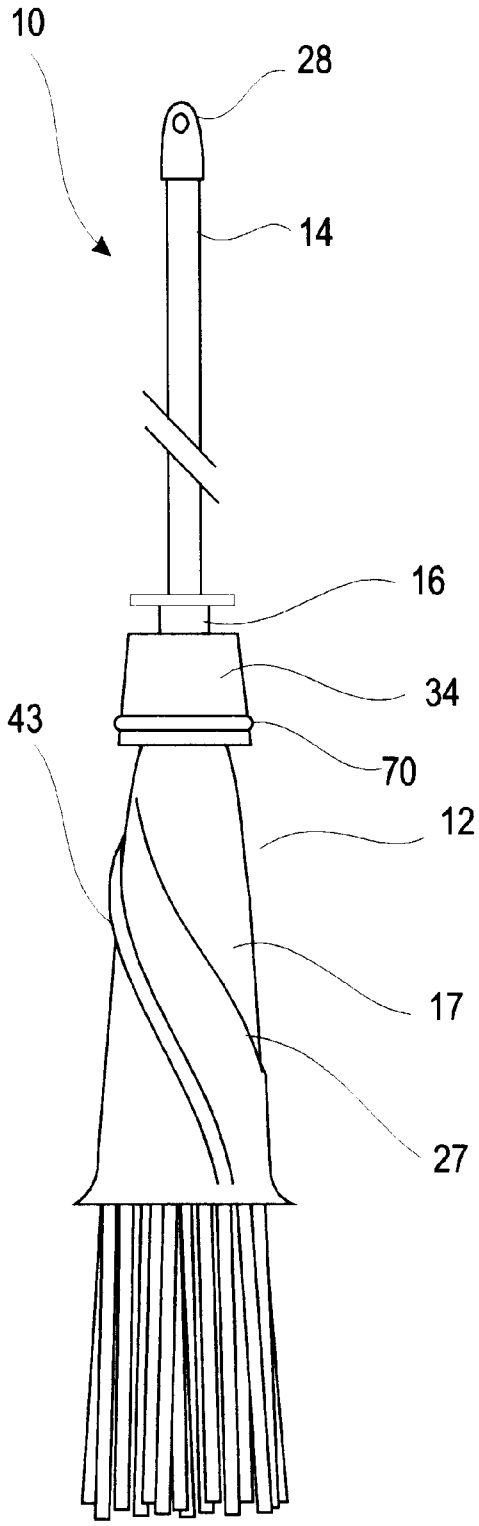
FIG. 2 is another side view of the mop having a self-container wringer in a partially retracted position.
Figure 3:
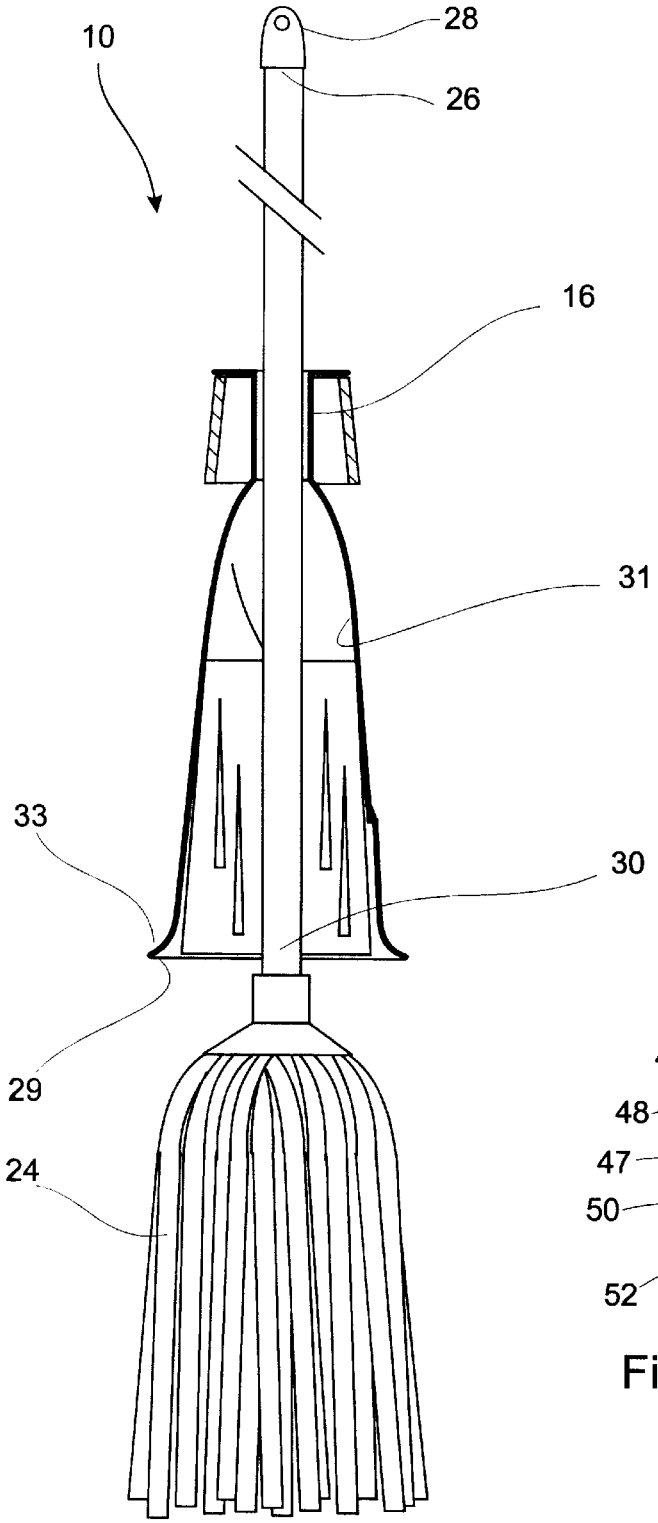
FIG. 3 is another side view of the mop having a self-container wringer in a retracted position.

A generally frustoconical second sleeve 34 is provided in a movably disposed fashion about the housing 17. The sleeve 34 has a diameter greater than the first end 23 and less than the second end 29. The sleeve 34 is retained about the housing 17 and between the collar 13 and lip 33. The sleeve 34 has a plurality of grooves 35 which extend along an inner surface of the sleeve 34. While four grooves 35 are shown, there only need be one. Any one of the grooves 35 may receive the ridge 43 therein and be used to as an aid to cause the housing 17 to wrap about itself as the sleeve 34 is moved toward the second end 29 thus squeezing the mop head material 24. The second sleeve 34 can have a radially protruding gripping surface 70 as seen in FIGS. 1 and 2.

The retainer member 18 has an end 42 which is formed with an open surface 44 which includes a portion threaded in a complimentary manner to receive the threaded end 30 of the handle 14. Another end 46 is generally frustoconical shaped with a receiving surface 47 and has at a center an threaded surface 48 which is threaded and extends partially into the retainer member 18.

The mop head material 24 includes a series of strips of absorbent and durable material as is known in the art, such as woven or unwoven natural or cotton yarn or synthetic materials. For example, the materials may be made of plastic, such as polyester, polyurethane or polyether, or of natural, such as cotton, for example. As shown in the present invention, but not to be limiting, the mop head material 24 is formed with a series of generally parallel cuts to create individual intermediate strips 50 which are joined at an open center surface 52 of each strip 50, wherein a portion of the insert 22 goes through the center surface 52 and connected to the threaded surface 48.

Figure 4:
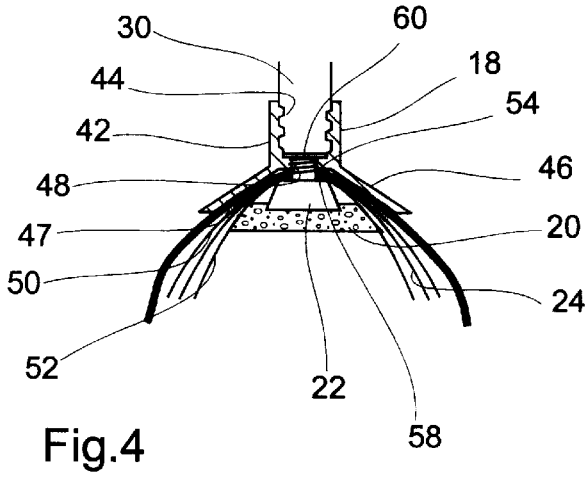
FIG. 4. is a cross sectional view of a retainer part of the mop of the present invention.
Figure 6:
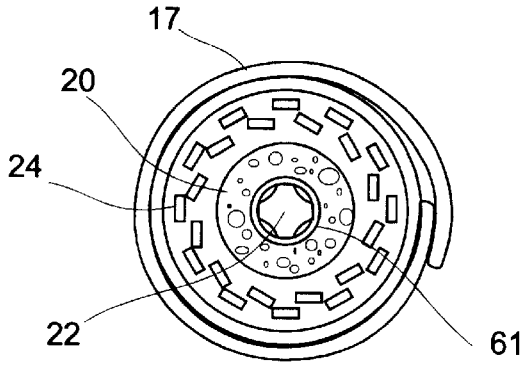
FIG. 6 is bottom view of the present invention.
Figure 5:
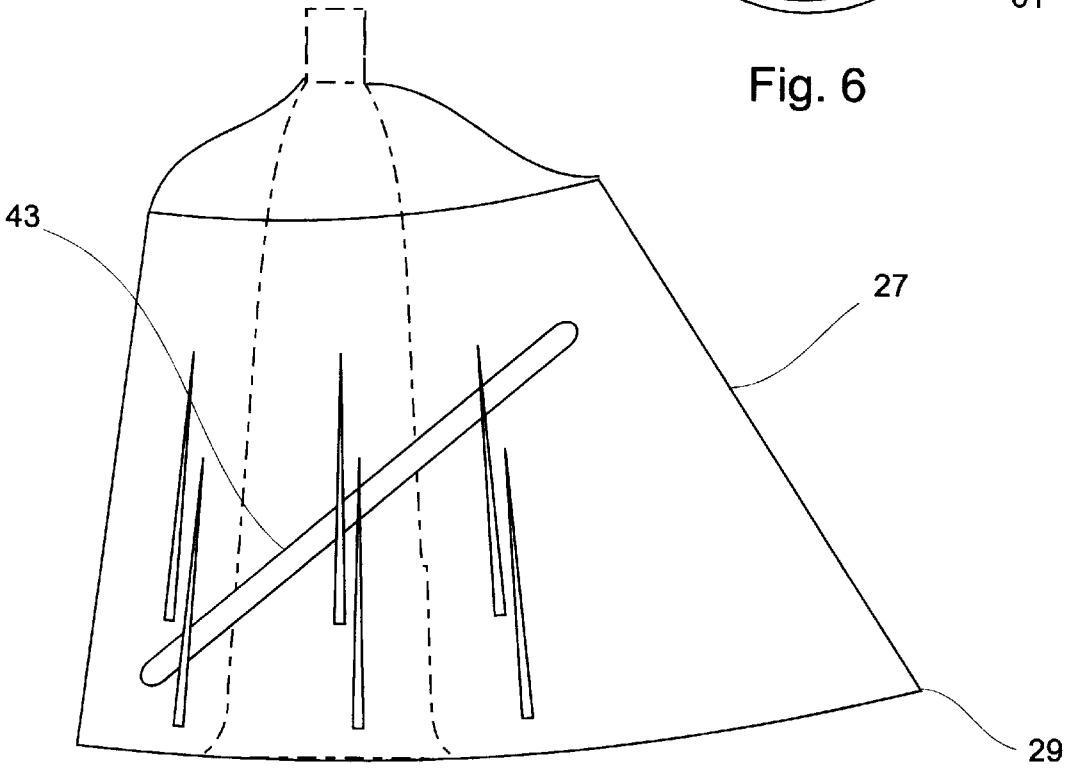
FIG. 5 is a view of a housing of the present invention.
Figure 8:
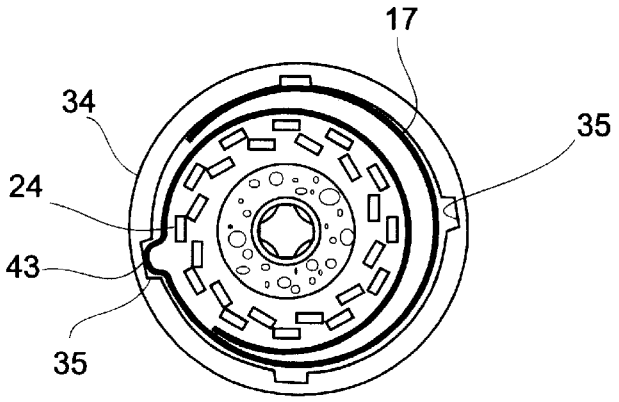
FIG. 8 is a cross section through line 8—8 of 1.

The optional resilient scrub pad material 20 may be made of any suitable durable scrubbing material and preferably of relatively semi-flexible type plastic, such as those previously mentioned but formed in a manner to accomplish this purpose. As shown in FIG. 4, the pad material 20 has an open surface 58 defined therein and is disposed adjacent ring 54 of the mop head material 24 and the receiving surface 47.

The insert 22 has a stem portion 60 which is threadably configured of a size to fit through the open surface 58 of the scrub pad material 20 and be threadably connectably received into the threaded surface 48 in a manner such that the insert 22 and scrub pad material 20 bind and lock the ends 52 of the mop head material 24 against the receiving surface 47. The insert 22 also has a gripping portion 61 to readily enable threaded connection of the insert to 22 the retainer member 18.

When the insert 22 is connected to the retainer member 18, it is substantially recessed below surrounding adjacent outer surface 62 of the scrub pad material 20 in a manner such that the insert 22 does not substantially affect the scrub pad material's ability to effectively scrub a surface.

By so providing the structure of the mop described herein, the present invention results in a new and improved mop having a self-contained wringer. The mop has the improved ability to fully use the mop head material with the wringing device being relatively light weight and which is readily retractable from the mop head material in a manner which allows peripheral access to the mop head.

The mop is relatively simplistic and inexpensive to manufacture. The self-contained wringer is retrofit ready for use with substantially any conventional wet-deck type mop. The wringer provides for greater squeezabilty. In addition, the second sleeve provides a squeezing aid which is used to reduce the housing's mop head receiving surface as it is moved over the housing toward the second end of the housing.

The above described embodiment is set forth by way of example and are not for the purpose of limiting the present invention. It will be readily apparent to those skilled in the art that obvious modifications and variations can be made to the embodiment without departing from the scope of the invention. Accordingly, the claims appended hereto should be read in their full scope including any such modifications and variations.

What is claimed is:

1. A mop having a self-contained wringer, which includes:

a handle having a first end and a second end;

a first sleeve frictionally movably disposed on said handle such that said first sleeve is self supporting along a number of positions along said mop handle;

a retainer member connected to a first end of said handle and having a retainer surface;

a mop head material having a first end connected to said retaining surface of said retainer member; and a housing portion having a first end connected to said first sleeve and said second end extending outwardly therefrom creating a mop head material receiving surface area between a portion of said handle and said inner surface of said housing, wherein said housing is movable along said handle via said first sleeve in a manner to removably enclose said mop head material and enable squeezing of said mop head material through application of pressure on said housing, and wherein said housing includes a slit extending from said second end thereof toward said first end thereof such that said housing may movably overlap itself and change said receiving surface.

2. The mop of claim 1, wherein said first sleeve is formed with an inner biasing member which imparts an ability of said first sleeve to be readily moved upon a user overcoming a frictional force of said biasing.

3. The mop of claim 1, wherein said housing is relatively flexible.

4. The mop of claim 1, wherein said housing is further characterized to be generally hemibulbous.

5. The mop of claim 1, wherein a diameter of said first end of said housing is about half that of said second end.

6. The mop of claim 1, wherein a first end of said first sleeve is connected to said housing and a second end of said first sleeve has a radially extending collar extending therefrom and further includes a second sleeve having a diameter greater than said first end of said housing and less than a diameter of said collar and said second end of said housing and is slidably movable over the housing.

7. The mop of claim 6, wherein said second end of said housing is formed with a radially extending lip and said second sleeve is movably retained between said lip and said collar.

8. The mop of claim 6, wherein said second sleeve is formed with a radially protruding gripping surface portion.

9. The mop of claim 1, wherein said first sleeve and said housing are integrally formed.

10. The mop of claim 1, which further includes a resilient scrub pad material connected to said retainer.

11. The mop of claim 1, which further includes a second sleeve having a diameter greater than said first end of said housing and less than a diameter of said second end of said housing and is slidably movable manner over the housing.

12. The mop of claim 11, wherein said housing is formed with a diagonally extending ridge and second sleeve is formed with a groove extending along an inner surface which slidably receives said ridge.

13. A retrofit self-contained wringer for connection to a conventional deck-type wet mop having a handle and a mop head connected thereto, which includes:

a first sleeve frictionally movably disposed on the handle such that said first sleeve is self supporting along a number of positions along said mop handle;

a housing portion having a first end connected to said first sleeve and said second end extending outwardly therefrom such that when connected to the handle creates a mop head material receiving surface area between a portion of the handle and an inner surface of said housing, wherein said housing is movable along the handle via said first sleeve in a manner to removably enclose the mop head and enable squeezing of said mop head material through application of pressure on said housing, and wherein said housing includes a slit extending from said second end thereof toward said first end thereof such that said housing may movably overlap itself and change said receiving surface; and a second sleeve slidably disposed about said housing in a manner to cause said housing to overlap and change said receiving surface as said second sleeve moves from said first end to said second end.

14. The retrofit self-contained wringer of claim 13, which further includes a second sleeve having a diameter greater than the first end and less than the second end and is slidably movable over said housing.

15. The retrofit self-contained wringer of claim 14, wherein said housing is formed with a diagonally extending ridge and second sleeve is formed with a groove extending along an inner surface which slidably receives said ridge.

16. The retrofit self-contained wringer of claim 13, wherein said first sleeve is further characterized to have an end connected to said housing and has another end formed with a radially extending collar to prevent said second sleeve from passing thereby and said housing has a second end formed with a radially extending lip, wherein said second sleeve is maintained between said lip and said collar.

17. The retrofit self-contained wringer of claim 13, wherein said first sleeve and said housing are integrally formed.

* * * * *